United States Patent [19]

Staresina et al.

[11] Patent Number: 4,930,278

[45] Date of Patent: Jun. 5, 1990

[54] COMPOSITE CEMENTITIOUS BUILDING PANELS

[75] Inventors: Stjepan Staresina, Burlington; John A. Rowe, Whitby, both of Canada

[73] Assignee: In-Ve-Nit International Inc., Ajax, Canada

[21] Appl. No.: 201,227

[22] Filed: Jun. 2, 1988

[51] Int. Cl.[5] ..... E04C 2/38

[52] U.S. Cl. ..... 52/315; 52/414; 52/600; 52/602

[58] Field of Search ..... 52/315, 600, 601, 319, 52/414, 602, 348, 349, 350, 356

[56] References Cited

U.S. PATENT DOCUMENTS

| | | | |
|---|---|---|---|
| 717,923 | 1/1903 | Rapp | 52/356 |
| 1,685,247 | 9/1928 | Selway | 52/356 |
| 2,704,935 | 3/1955 | Uddenborg | 52/601 X |
| 3,363,371 | 1/1968 | Villalobos | 52/356 X |
| 3,657,853 | 4/1972 | Wise | 52/361 X |
| 4,185,437 | 1/1980 | Robinson | 52/601 |
| 4,602,467 | 7/1986 | Schilger | 52/319 |

FOREIGN PATENT DOCUMENTS

| | | | |
|---|---|---|---|
| 85531 | 5/1958 | Denmark | 52/348 |
| 1418289 | 12/1975 | United Kingdom . | |
| 2019469 | 10/1979 | United Kingdom . | |

*Primary Examiner*—David A. Scherbel
*Assistant Examiner*—Lan Mai
*Attorney, Agent, or Firm*—Kenneth M. Garrett

[57] ABSTRACT

Composite building panels comprising a slab of cementitious fiber reinforced material and a stud framework keyed thereto. The studs have a flange which abuts the inner surface of the slab, and a plurality of tabs which project downwardly from the flange to key the stud. Adjacent tabs are axially spaced apart, and may also be transversely staggard, to reduce the incidence of cracking of the slab, and may be upset from the flange material. The slabs may be relatively thin i.e. 2 cms. The tabs may also serve to retain rod or mesh reinforcement in thicker slabs.

15 Claims, 2 Drawing Sheets

COMPOSITE CEMENTITIOUS BUILDING PANELS

FIELD OF INVENTION

This invention relates to improvements in preformed building panels comprising a slab of cementitious material and a framework of metal studs bonded thereto, and to studs for use in the manufacture of said building panels.

BACKGROUND OF INVENTION

It is known in the prior art to provide building panels of the foregoing nature. In accordance with one proposal (ROBINSON, U.S. Pat. No. 4,185,437) a frame work of studs is secured to the planar surface of a cementitious slab by applying cementitious overlays at intervals to a flange portion of the studs. The overly increases the thickness of the slab locally, but the studs do not penetrate below the planar surface of the slab. The method is relatively labour intensive, and the quality of the panels may show considerable variance.

In accordance with other proposals, the studs are provided on the flange portion with a downwardly stepped key. The framework of studs is placed onto the slab before set up, so that the key projects below the planar surface of the slab. The key is continuously formed along the length of the stud. Where the mass of cementitious material is relatively limited i.e. in slabs having a thickness of between below about 5 to about 10 cm (2 to 4 inches), the panels can be subject to stress cracking along the line of the key. Where the slabs are even more thin i.e. having a thickness of 2 to 3 cm ($\frac{3}{4}$ to $1\frac{1}{4}$ inches), the tensile strength along the line of the key is critically diminished.

Once preformed building panels are installed, they tend to be subject primarily to compressive forces, hence the degree to which the studs are keyed to the slab need not be great. However, during storage, transportation and installation, the studs may be subject to adventitious tensile forces tending to rotate the studs about their longitudinal axis, and also tending to move the studs along their longitudinal axis. In thicker slabs of cementitious material, the keys may be relatively large and deeply embedded and able to withstand the adventitious forces. In the thinner slabs, the keys are necessarily smaller and less deeply embedded, and as a consequence they may break out from the slab under the influence forces.

There is a further problem encountered in preformed building slabs wherein a continuous wire rod or mesh is embedded in the slab. Generally speaking the rod or mesh is attached to the framework of studs, usually by tying with wire, in a labour intensive operation.

It is an object of this invention to provide improvements in preformed building panels comprising a cementitious slab having a framework of studs secured thereto.

It is a further object of this invention to provide building panels of the foregoing nature wherein the cementitious slab may be relatively thin.

It is a still further object of this invention to provide building panels which may be thin and yet which may better withstand certain forces to which they may be subject.

It is yet another object of this invention to provide building panels having a continuous reinforcement embedded therein which is held in place by means formed unitarily with the studs.

It is still another object of this invention to provide studs for use in the construction of building panels.

SUMMARY OF THE INVENTION

In accordance with one aspect of this invention, a building panel comprises a thin slab of cementitious material having a generally planar inner surface, and a framework comprising a plurality of axially elongated, transversely spaced apart studs. Each stud has a flange portion and a web portion upstanding therefrom, and a plurality of axially spaced apart tabs downwardly dependent from the flange portion.

The flange portion of the studs locates substantially on the planar surface of the slab, with the tabs being embedded in the slab to key the studs into place.

Suitably the tabs may be finger like, and have their major axis in axial alignment with the stud, although a skewed or transverse arrangement is not precluded.

Preferably, where the tabs are finger like and axially aligned, the major axis of adjacent tabs is transversely offset; also preferably, adjacent finger like tabs point in axially opposed directions.

Expediently the tabs may be unitarily formed with the flange, for example by slitting the flange about the periphery of the tab, thereby creating openings in the flange which may themselves assist in keying the stub to the cementitious slab.

By spacing the keying tabs axially apart, the surface of the slab is not continuously interrupted, and is thereby better able to resist cracking. The spacing between the parallel end portions and the flange is not critical, and will depend upon the thickness and other characteristics of the cementitious material, so as to provide a correct balance between good keying of the stud to the slab on the one hand, and a resistance to cracking along the line or lines of the tabs.

The keying effect of the tabs may be enhanced by suitably shaping and orienting the tabs. Thus, where the tabs are finger like, it will be preferred that alternate tabs point in opposed directions so as to resist axial detaching forces that are applied to the stud at either axial end thereof.

It is also preferred that at least a portion of each tab will subtend an angle of other than 90° to the plane of the flange, so as to resist detaching forces applied to the stud at right angles to the plane of the slab. Where the tabs are finger like, the end portion may suitably be parallel to the plane of the flange. Where the dimension of the tab increases therealong, the thickness of the metal may itself provide the requisite keying action.

While in the preferred embodiment the studs are formed with tabs connecting to the flange along lines that are transverse to the longitudinal edges of the flange, or possibly skewed relative thereto, it is further contemplated that the tabs may be connected to the flange along an axial line or lines. In accordance with a second embodiment, one longitudinal edge of the stubs is transversely slit at intervals therealong, and the flange material between successive pairs of slits is downwardly deformed to create the tabs. In general this type of tab is less preferred, at least where it is formed in the manner described, as it tends to weaken the flanges. However, it is not precluded that the flanges could be initially formed with excess material along one or both longitudinal edges of the flange, from which the desired plurality of discrete keying tabs could be formed.

Although in some circumstances it will be preferred to form the tabs unitarily with the flange of the studs, it is recognized that this may necessitate special equipment; accordingly in other circumstances it may be preferable to secure tabs to the flange of a commonly available stud. In accordance with a further embodiment of the invention the tabs comprise a shank secured to the stud by any convenient means, for example screwing or rivetting, the shank having a radially enlarged head.

The invention will be further described in relation to specific embodiments thereof as illustrated in the accompanying drawings wherein:

DESCRIPTION OF THE PREFERRED EMBODIMENT

Figure 1:
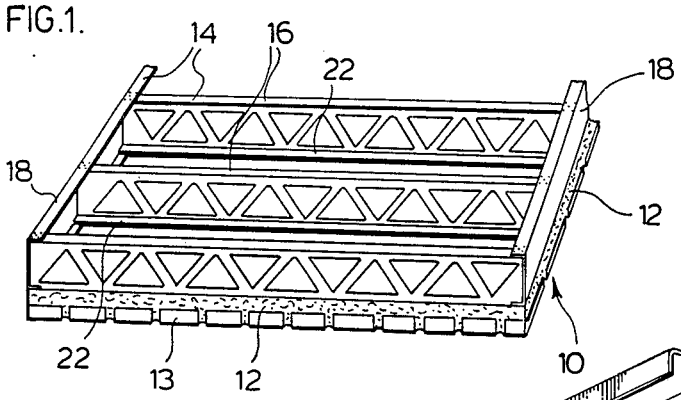
FIG. 1 shows in perspective view a portion of a building panel.

Referring to the drawings in detail, a building panel constructed in accordance with the invention is identified in FIG. 1 generally by the numeral 10, and comprises a thin cementitious slab 12. Suitably slab 12 may be formed from an aggregate of Portland cement, relatively fine silicaceous filler, such as sand, polymeric additive materials and will desirably include reinforcing fibers, as is generally known in the art.

While the thickness of slab 12 is not critical, and will to a considerably extent depend upon the composition of the slab, the term "thin slab" will generally refer to slabs having a thickness of some 2 to 3 cms (approximately ¾" to approximately 1¼"). However, there is no precise lower limit or upper limit to the thickness of slab 12. Slab 12 is formed by pouring into a suitable casting form (not shown). The casting form may be lined with a decorative finish material, for example brick veneer 13, which thereby becomes integrally bonded to slab 12 on the exterior surface thereof.

Prior to pouring slab 12, a rigid framework 14 is formed comprising a plurality of axially elongated studs 16 transversely spaced apart, with each axial end thereof locked into an end channel 18 by rivetting, screwing or any other convenient means. The bounding periphery of framework 14 is generally coextensive with the periphery of the casting form.

Figure 2:
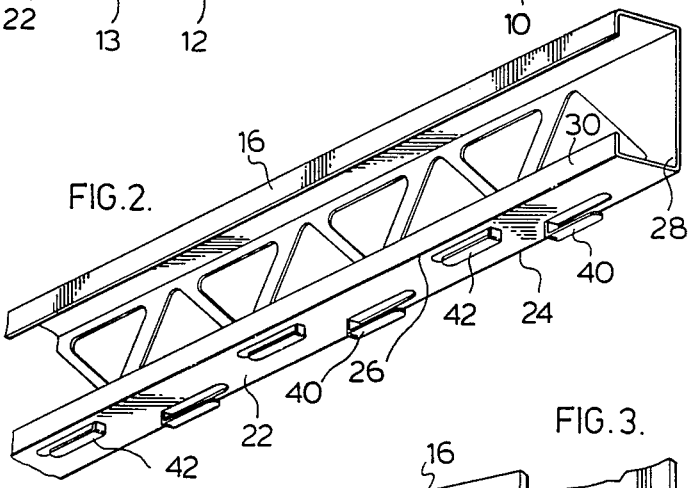
FIG. 2 shows in perspective view from below a portion of a stud in accordance with the invention suited for use in the construction of the building panel of FIG. 1.

As best seen in FIG. 2, studs 16 have a generally rectangular C shaped cross section, and include a lower flange 22 having transverse edges 24,26, and a web 28 upstanding from edge 24. Edge 26, which may be referred to as the free edge of stud 16, is upwardly turned at 30 to form a small lip which strengthens the stud.

Figure 3:
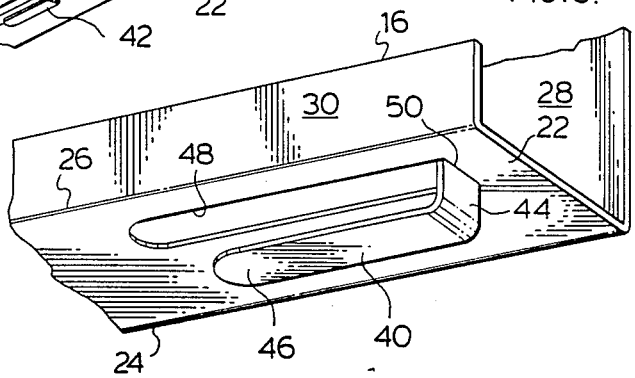
FIG. 3 shows detail of the stud of FIG. 2.
Figure 4:
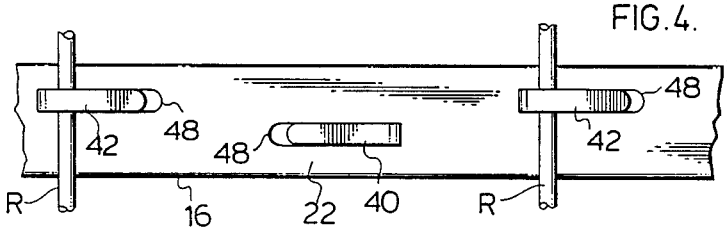
FIG. 4 shows in plan view from below a portion of the stud of FIG. 2, together with reinforcing rod secured thereby.

Stud 16 has a first plurality of tabs 40, and a second plurality of tabs 42, each of which tabs are downwardly dependent from flange 22. As best seen in FIG. 3, tab 40 comprises a root portion 44, the plane of which generally subtends a right angle to the plane of flange 22, and an end portion 46, the plane of which is generally parallel to the plane of flange 22. Tabs 40 are struck from flange 22 inwardly of transverse edges 24,26, thereby forming a window opening 48 in flange 22. Root portion 44 connects to flange 22 along a line 50 at right angles to transverse edge 24,26. Tabs 42 are identically configured to tabs 40, but point in an axially opposed direction; additionally, and as best seen in FIG. 4, tabs 40 align on a first axis and tabs 42 align on a second axis transversely offset therefrom, which axes are parallel to the major axis of stud 16.

The dimensions of tabs 40,42 are not critical and will vary somewhat according to the precise application of stud 16. Conveniently the root portion 44 has a length such that the clearance between the end portion 46 and the flange 22 is approximately 1 cm (⅜ inch), whereby steel reinforcing rods R which may be in the form of a mesh, of up to this diameter can be secured to stud 16 without the use of wiring or other expedients. The tabs 40,42 are conveniently formed on 15–20 cm centres, (6–8 inches) between adjacent tabs, so as to be a modular distance or a multiple thereof a wire mesh where this is used with the studs. Suitably the overall length of each tab 40,42 will be apart 5 cm (2 inches) whereby the root portion 44 is approximately 20% of the overall length of the tab. The combined length of the finger-like tabs 40,42 along a stud will generally comprises about 25% to approximately 33% of the length of the stud. The width of tabs 40,42 may conveniently be about 1 cm (⅜ inch).

Building panel 10 may be used in wall or floor constructions, according to the nature of slab 12, its thickness and the type of reinforcement. Thin slabs having fiber reinforcement will find greatest use in wall construction. The alternating direction of the tabs 40,42 will ensure that one half of the tabs are always upwardly oriented, such tabs having a greater mechanical retaining action than do the downwardly oriented tabs.

It will be remarked that as framework 14 is positioned on newly poured slab 12, cementitious aggregate will tend to extrude through window openings 48 to increase the thickness of the slab in the critical area which the tabs penetrate the slab, and also to key onto the flange 22 around the opening defining window opening 48, thereby strengthening the building panel 10. The amount of extrusion of the cementitious material through windows 48 is conveniently controlled by the downward pressure exerted on framework 14. Desirably the slab 12 is vibrated prior to set-up of the cementitious material so as to assist the flow of the material about tabs 40,42 and to release trapped air.

While the transverse separation of tabs 40 and 42 has a primary effect of lessening the tendency of cracking of slab 12 between adjacent tabs, it has a secondary but important effect of increasing the width over which a stud is keyed to the slab. The keying width may also be increased by increasing the width of the tabs; preferably the width is increased in the end portion thereof, so as not to increase the likelihood of cracks developing around the root portion of the tab.

Figure 5:
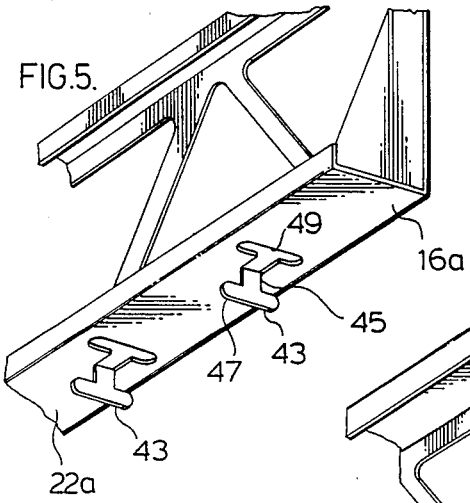
FIG. 5 is similar to FIG. 2 but shows a second embodiment of a tab.

With reference to FIG. 5 a stud **16*a* generally similar to stud 16 earlier described is provided with tabs 43 that are generally T-shaped and comprise a root portion 45** and head portion 47 having a width approximately 2 to 3 times that of the root portion. Tabs 43 are struck from flange 22*a* thereby forming window openings 49. There is little tendency of longitudinal cracking of slab 12 when tabs such as tab 43 are employed, due to the limited axial dimension of such tabs, hence it is not necessary that adjacent tabs be transversely offset.

As earlier observed, the formation of keying tabs by their being punched from the flange of a stud may be advantageous in providing a window through which cementitious material may be extruded and thereby assist in keying the stud to the underlaying slab. However, this necessitates the use of highly specialized manufacturing equipment to punch the tabs, thereby generally precluding the on-site conversion of standard studs for use in the construction of thin building panels.

Figure 6:
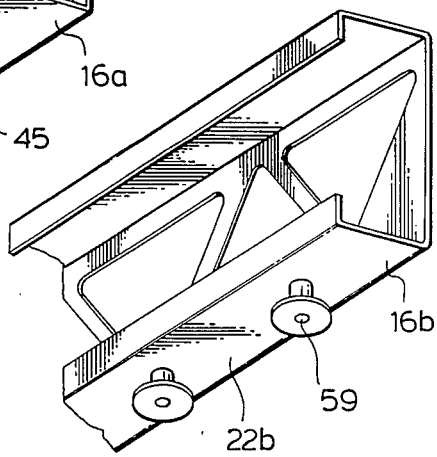
FIG. 6 is similar to FIG. 2 but shows a third embodiment of a tab.
Figure 7:
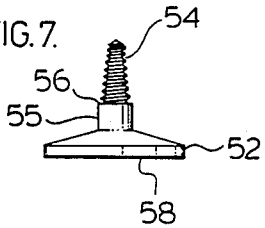
FIG. 7 shows the tab of FIG. 6 in side elevation.

With reference to FIGS. 6 and 7, a stud 16*b* generally similar to stud 16 is provided with screw-on tabs 52 dependent from flange 22*b*. Tabs 52 comprise a sheet metal screwed portion 54 which connects to a shank portion 55 at a shoulder 56, and a radially enlarged head portion 58. On the lower face of head portion 58 there is provided a recess 59 for receiving a screw driver blade (not shown). Adjacent tabs 52 are transversely staggered to reduce the tendency of cracking of slab 12. The surface of enlarged head portion 58 on the side thereof adjacent flange 22*b* is preferably inwardly upwardly angled so as to reduce the danger of trapping air bubbles thereon particularly adjacent shank 55.

Figure 8:
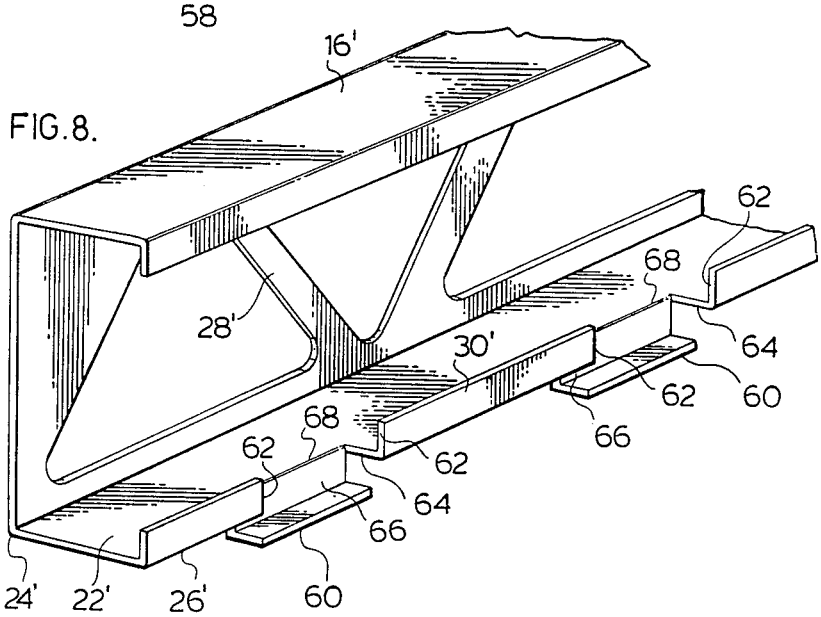
FIG. 8 is similar to FIG. 2 but shows a fourth embodiment of a tab.

In accordance with a further embodiment shown in FIG. 8, a stud 16' has a lower flange 22' and transverse edges 24', 26', a web 28' upstanding from edge 24', and a small strengthening lip 30' upwardly formed from edge 26', comparable to similar parts of stud 16 earlier described. A plurality of axially spaced apart tabs 60 are conveniently formed on flange 22' by making slits 62 in edge 26' and lip 30' at intervals along the length of stud 16', and downwardly deforming the flange material between pairs of slits 62, thereby forming a door opening 64 in flange 22'. Tabs 60 have a root portion 66 which connects to flange 22' along a line 68 parallel to the longitudinal axis of stud 16' somewhat inwardly of edge 26'. In a stud 16' suited for use with thin slabs of cementitious material, tabs 60 may suitably have a depth of about 1 cm (⅜ inch), a length taken on the longitudinal axis of about 5 cm (2 inches) and be located on centres that are 15–20 cms apart (6–8 inches), whereby the combined length of tabs 60 is approximately 25 to 33% of the length of the stud. The plane of lip potion 30' of edge 26', where flange 22 is downwardly upset to form tabs 60, is generally parallel to the plane of flange 22, thereby providing a firm anchor for studs 16' in the building panel. As in the first embodiment, when a framework formed by studs 16' is pressed onto a freshly poured slab 12, this will extrude cementitious material through door openings 64 to increase the thickness of the slab marginally in these areas and thereby achieve an enhanced keying of studs 16' to the slab.

It will be apparent that many changes to the foregoing embodiments may be made while meeting one or more objects of the invention, and it is intended that such changes be encompassed by the claims annexed hereto.

We claim:

1. A building panel comprising:

a thin slab of cementitious material having a generally planar inner surface;

a plurality of transversely spaced apart axially elongated studs, each said stud including a flange portion and a web portion upstanding from said flange portion; and a plurality of finger like tabs connected directly to said flange portion at axially spaced apart intervals therealong to downwardly depend therefrom, said tabs each comprising a minor root portion contained in a plane generally at right angles to the plane of said flange portion, and a major end portion contained in a plane generally parallel to the plane of said flange portion, said flange portion locating substantially in the planar inner surface of said slab with said tabs being embedded in said slab to lock said studs thereto.

2. A building panel as claimed in claim 1, wherein said tabs have their major axis aligned with the major axis of said studs.

3. A building panel as claimed in claim 2, wherein the major axis of adjacent said tabs is transversely offset.

4. A building panel as claimed in claim 2, wherein adjacent said tabs point in opposed directions.

5. A building panel as claimed in claim 3, wherein said adjacent tabs point in opposed directions.

6. A building panel as claimed in claims 1, 2 or 3 wherein said tabs are unitarily formed with said flange and have window openings associated therewith, and wherein said cementitious material passes through said openings.

7. A building panel as claimed in claims 2, 3 or 4, wherein said tabs comprise a root portion which connects to said flange portion along a line transverse to the major axis of said flange portion and an end portion the plane of which is generally parallel to the plane of said flange, and wherein said root portion is about 20% of the total length of the associated tab.

8. A building panel as claimed in claims 2, 3 or 4, wherein the combined length of said tabs is approximately 25% to approximately 33% of the combined length of said studs.

9. A building panel as claimed in claim 1, wherein said tabs are T-shaped.

10. A building panel as claimed in claim 1, wherein said tabs of said stud connect thereto along an axial line.

11. A building panel as claimed in claim 1, wherein said tabs of a said stud are formed by downwardly deforming a transverse edge of said stud at axially spaced apart intervals therealong.

12. A building panel as claimed in claims 9, 10, 11, wherein at least a portion of each said tab subtends an angle of other than 90° to said flange.

13. A building panel as defined in claim 1, including a channel secured to each axial end of each said stud.

14. A building panel as claimed in claim 1, wherein said tabs are screwably secured to said flange.

15. A building panel as claimed in claim 14, wherein said tabs include a shank portion and an enlarged head portion.

* * * * *